US006186157B1

(12) United States Patent
Lin et al.

(10) Patent No.: US 6,186,157 B1
(45) Date of Patent: Feb. 13, 2001

(54) WINDPROOF UMBRELLA HAVING COMPACT FOLDED STRUCTURE

(75) Inventors: Chung-Kuang Lin; Jung-Jen Chang, both of Taipei Hsien (TW)

(73) Assignee: Fu Tai Umbrella Works, Ltd., Taipei Hsien (TW)

( * ) Notice: Under 35 U.S.C. 154(b), the term of this patent shall be extended for 0 days.

(21) Appl. No.: 09/411,635

(22) Filed: Oct. 4, 1999

(51) Int. Cl.[7] ..... A45B 25/02
(52) U.S. Cl. ..... 135/27; 135/25.1
(58) Field of Search ..... 135/27, 29, 31, 135/33.5, 37, 44, 22, 23, 20.3, 15.1, 25.1

(56) References Cited

U.S. PATENT DOCUMENTS 3,032,047 * 5/1962 Wendorf ..... 135/27
3,930,514 * 1/1976 Wu ..... 135/27
4,407,317 * 10/1983 Crandall ..... 135/27
5,213,123 * 5/1993 Whitfield ..... 135/27
5,794,637 * 8/1998 Figueroa ..... 135/27
5,941,261 * 8/1999 Kouvaras et al. ..... 135/27
6,006,770 * 12/1999 Lin et al. ..... 135/27
6,058,952 * 5/2000 Lin et al. ..... 135/29

* cited by examiner

*Primary Examiner*—Peter M. Cuomo
*Assistant Examiner*—Jerry A. Anderson
(74) *Attorney, Agent, or Firm*—Dougherty & Troxell

(57) ABSTRACT

A windproof umbrella includes: a central shaft, a rib assembly having at least a top rib and a stretcher rib pivotally secured to the central shaft for securing an umbrella cloth thereon, a pulling rod secured on the stretcher rib and a pulling rope connected between the pulling rod and the top rib (or an outer rib portion of the rib assembly), with the pulling rope and pulling rod fastening the top rib (or the outer rib portion of the rib assembly) towards the central shaft for preventing inversion of the umbrella cloth and the rib assembly when opening the umbrella, whereby upon folding of the umbrella, the pulling rod and pulling rope will be tensely folded within the rib assembly without loosening for forming a compact folded umbrella.

15 Claims, 9 Drawing Sheets

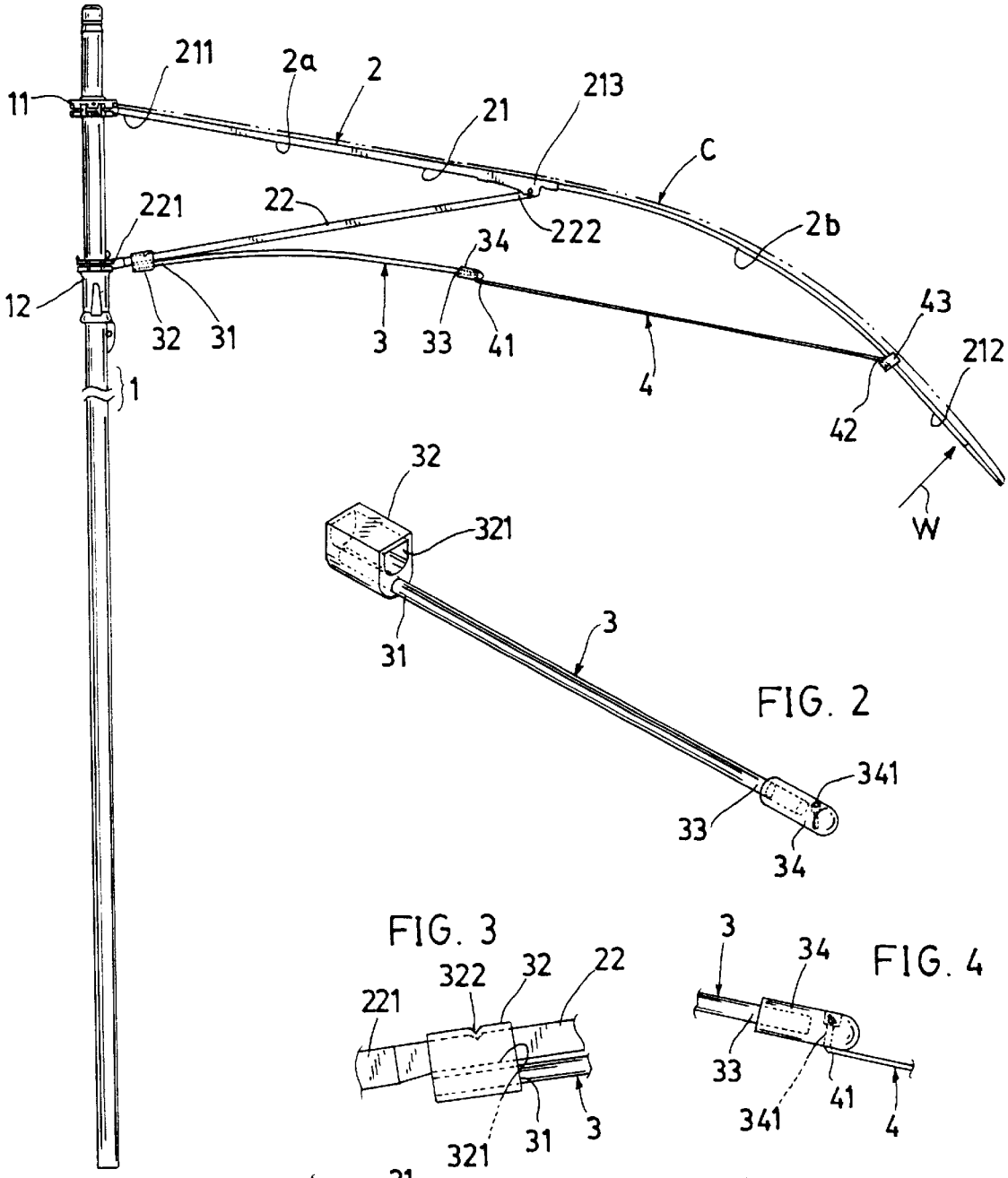
FIG. 1
FIG. 2
FIG. 3
FIG. 4
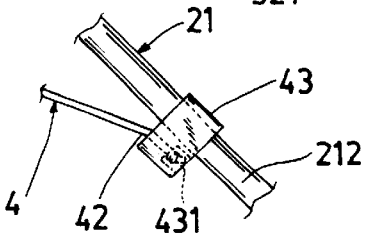
FIG. 5
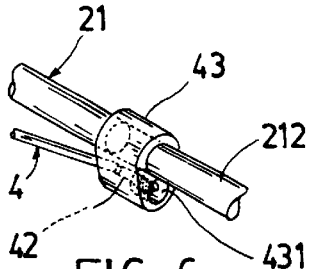
FIG. 6

WINDPROOF UMBRELLA HAVING COMPACT FOLDED STRUCTURE

BACKGROUND OF THE INVENTION

U.S. Pat. No. 5,794,637 disclosed a non flip umbrella including a plurality of reinforcing strings (21) each connected between the sliding catch (14) and each rib (13), and a plurality of suspenders (22) each fastened between each reinforcing string (21) and each rib (13) to prevent the reinforcing strings (21) from drooping out of the umbrella when folded.

However, such a prior art still has the following drawbacks:

1. Each suspender (22) should require a pair of upper and lower rings (26, 26*a*) to be held in position between the rib (13) and the string (21), greatly increasing the installation inconvenience and the production cost thereof.
2. Even the suspenders (22) are provided for preventing the drooping of the strings (21) from the folded umbrella (FIG. 6 of the prior art), the strings (21) are still loosened, possibly causing tangling when folding or unfolding the umbrella.
3. If the suspender is modified to be a suspending spring (31) as shown in FIG. 4 of the prior art, there may be 6~8 springs (31) totally for an umbrella, being heavy and inconvenient for portable uses.
4. Around the central pole (11), the inner end of each string (21) and brace (19) should be pivotally secured to the ring (18) which is positioned at such a narrow crowded space, thereby increasing the assembly complexity and inconvenience. If an additional ring member (28) is provided for connecting the string (29) as shown in FIG. 4 of the prior art, the assembly cost will then be increased.

The present invention has found the drawbacks of the prior art and invented the present windproof umbrella having compact folded structure.

SUMMARY OF THE INVENTION

The object of the present invention is to provide a windproof umbrella including: a central shaft, a rib assembly having at least a top rib and a stretcher rib pivotally secured to the central shaft for securing an umbrella cloth thereon, a pulling rod secured on the stretcher rib and a pulling rope connected between the pulling rod and the top rib (or an outer rib portion of the rib assembly), with the pulling rope and pulling rod fastening the top rib (or the outer rib portion of the rib assembly) towards the central shaft for preventing inversion of the umbrella cloth and the rib assembly when opening the umbrella, whereby upon folding of the umbrella, the pulling rod and pulling rope will be tensely folded within the rib assembly without loosening for forming a compact folded umbrella.

BRIEF DESCRIPTION OF THE DRAWING

FIG. 1 shows an opened umbrella of the present invention.

FIG. 2 is a perspective view showing the pulling rod of the present invention.

FIG. 3 shows the inner rod portion of the pulling rod secured on the stretcher rib.

FIG. 4 shows the connection of an outer rod portion of the pulling rod with the pulling rope.

FIG. 5 shows an outer rope end of the pulling rope secured on an outer portion of the top rib.

FIG. 6 is a perspective view of FIG. 5.

DETAILED DESCRIPTION

Figure 7:
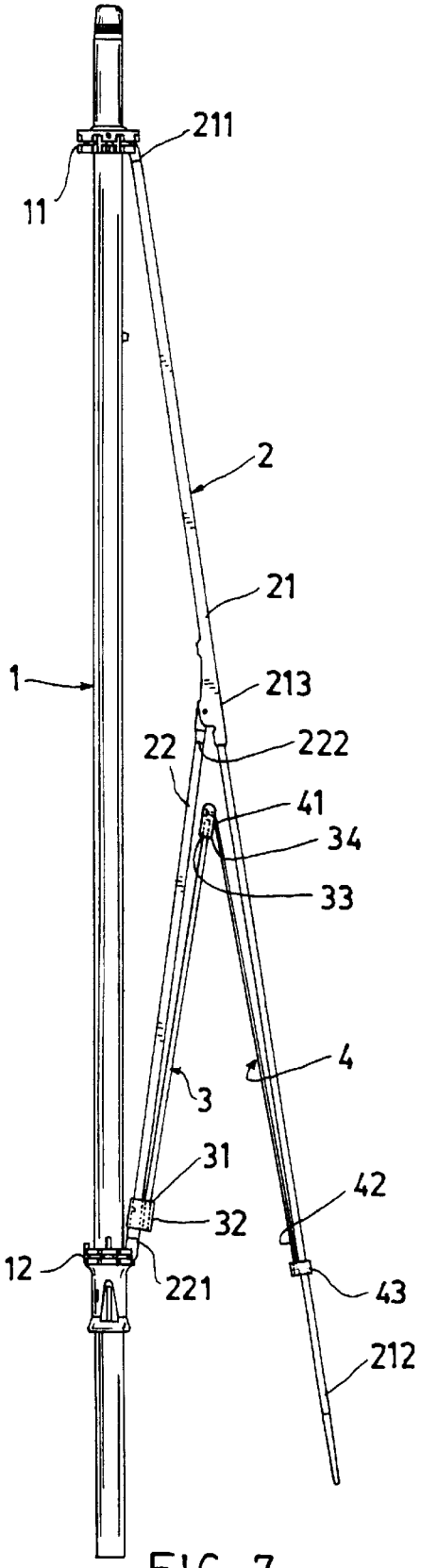
FIG. 7 shows a folded umbrella of the present invention.

As shown in FIGS. 1~8, a preferred embodiment of the windproof umbrella of the present invention comprises: a central shaft 1, a rib assembly 2 pivotally secured to an upper notch 11 and a lower runner 12 slidably held on the central shaft 1, an umbrella cloth C secured on the rib assembly 2 and the upper notch 11, a pulling rod 3 secured to an inner portion 221 of the stretcher rib 22, and a pulling rope 4 connected between the pulling rod 3 and an outer portion 212 of the top rib 21.

The rib assembly 2 as shown in FIG. 1 is provided for a single fold umbrella of the present invention. However, the number of folds of the present invention are not limited. For instance, the rib assembly 2 as shown in FIGS. 13~24 is provided for two-fold umbrella.

The rib assembly 2 includes: a top rib 21 having its inner portion 211 pivotally secured to the upper notch 11, a stretcher rib 22 having an inner portion 221 of the stretcher rib 22 pivotally secured to the lower runner 12, with an outer portion 222 of the stretcher rib 22 pivotally secured to an intermediate rib portion 213 of the top rib 21.

The top rib 21 may be formed with an inner rib section **2*a* made of light aluminum alloy having a cross section of U shape, and with an outer rib section 2*b* joined with the inner rib section 2***a* and made of elastic rod such as fiber glass reinforced plastic material having a cross section of circular shape at the intermediate rib portion 213, but the materials and structure of the rib 21 being not limited in this invention.

The pulling rod 3 includes: an inner adapter 32 formed on an inner rod portion 31 of the pulling rod 3, and an outer adapter 34 formed on an outer rod portion 33 of the pulling rod 3. The pulling rod 3 may be made of fiber glass reinforced plastic, carbon fiber or any other suitable materials having proper elasticity and toughness; having a cross section of circular, square, flat or arcuate shapes. The rod 3 may also be formed as an elongated slim plate, strip, bar, and so on.

The inner adapter 32 of the pulling rod 3 is formed with a rib hole 321 engageable with an inner portion 221 of the stretcher rib 22 for securing the inner adapter 32 on the inner portion 221 of the stretcher rib 22. A further pressing 322 (FIG. 3) may be made for firmly fixing the adapter 32 on the stretcher rib 22.

The outer adapter 34 of the pulling rod 3 may be formed as a cylindrical shape as shown in FIG. 2 having an inner rope socket 341 vertically formed in the outer adapter 34 for fastening an inner rope end 41 of the pulling rope 4 in the socket 341 of the outer adapter 34. The rod 3 may be formed as a cylindrical rod as shown in FIG. 2.

The pulling rope 4 may be made of nylon rope or other ropes or wires having suitable tensile strength. An outer rope end 42 of the pulling rope 4 may be secured in an outer rope socket 431 formed in an outer connector 43 secured to the outer portion 212 of the top rib 21 as shown in FIGS. 1, 5, and 6. The outer connector 43 may be formed as a bracket fixed on the lop rib, or as other structures, not limited in the present invention.

The pulling rod 3 has a length preferably slightly less than a length of the stretcher rib 22, and the rod 3 may have a length not less than a half of the length of the stretcher rib 22, with the outer rod portion 33 approximating the outer portion 222 of the stretcher rib 22 adjacent to the intermediate rib portion 213 of the top rib 21 when the umbrella is folded (FIG. 8); and the pulling rope 4 has a length preferably slightly less than a distance between the intermediate rib portion 213 of the top rib 21 and the outer portion 212 of the top rib 21, with the length of the pulling rope 4 being not less than one half of the distance between the intermediate rib portion 213 and the outer portion 212 of the top rib 21.

Figure 8:
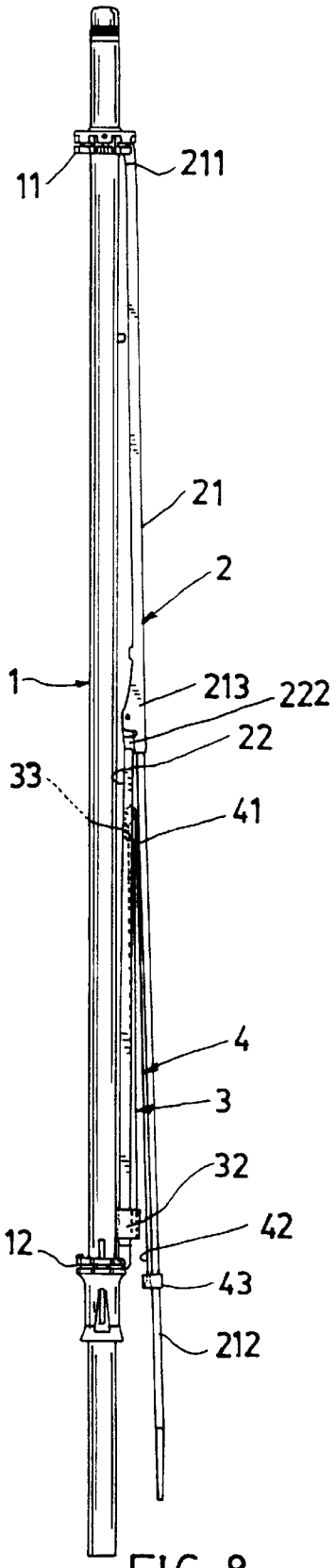
FIG. 8 shows a completely folded umbrella from FIG. 7.
Figure 9:
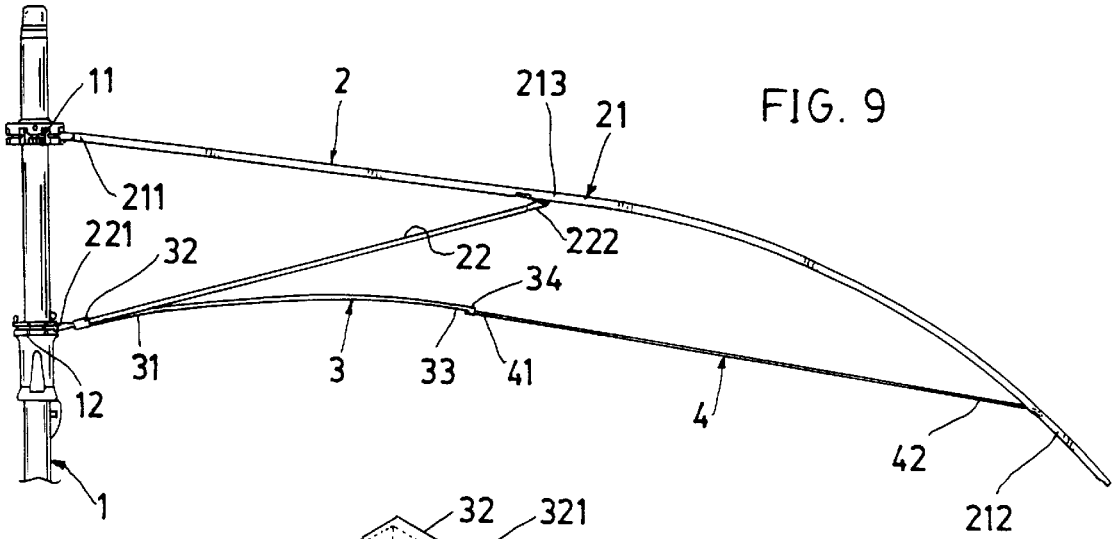
FIG. 9 shows an opened umbrella of another preferred embodiment of the present invention.
Figure 10:
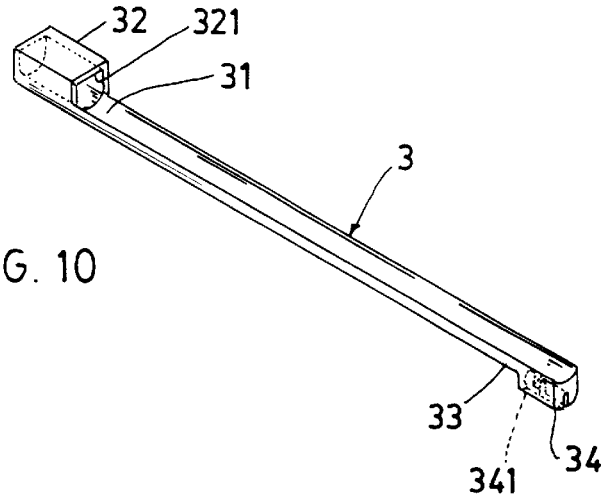
FIG. 10 shows a pulling rod of the umbrella as shown in FIG. 9.
Figure 11:
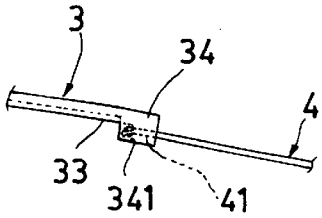
FIG. 11 shows a connection of the pulling rod and the pulling rope of FIG. 9.
Figure 12:
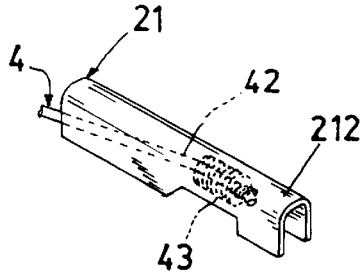
FIG. 12 is a perspective view showing the outer rope end of the pulling rope secured on the outer portion of the top rib of FIG. 9.

By the way, the pulling rod 3 will be leaned on or approximated to the stretcher rib 22 when the umbrella is folded; while the pulling rope 4 is tensely pulled between the pulling rod 3 and the outer portion 212 of the top rib 21 as shown in FIG. 8, without sagging or loosening of the rope 4 or the rod 3, so as to form a compact slim folded umbrella for preventing tangling or confusion of the rope 4 on the rod 3.

When the umbrella of the present invention is opened as shown in FIG. 1 and subjected to a strong wind W blowing the rib assembly 2 and umbrella cloth C upwardly, the pulling rope 4 and the pulling rod 3 will cooperatively fasten the outer portion 212 of the top rib 21 towards the inner portion 221 of the stretcher rib 22 for stably fastening the cloth C and the rib assembly 2 towards the central shaft 1 for preventing inversion of the umbrella cloth C and the rib assembly 2.

The inner adapter 32 of the inner rod portion 31 may be easily secured to the inner portion 221 of the stretcher rib 22. The inner rope end 41 of the pulling rope 4 may also be easily fastened to the outer adapter 34 of the outer rod portion 33 of the pulling rod 3 such as by forming a knot on the inner rope end 41 of the rope 4 to be fastened in a socket 341 formed in the outer adapter 34 of the rod 3; while the outer rope end 42 of the rope 4 may also be easily fastened to an outer connector 43 secured on the top rib 21, such as by forming a knot on the outer rope end 42 to be fastened into the socket 431 in the outer connector 43.

Another preferred embodiment of the present invention is shown in FIGS. 9~12, in which the top rib 21 is formed as a single rib independently (not consisting of two rib sections 2*a*, 2*b* as shown in FIG. 1), and the pulling rod 3 is formed as an elongated flat strip or plate having a shallow arcuate groove recessed downwardly in the upper portion of the pulling rod 3 to be engageable with a bottom wall of the stretcher rib 22 when the umbrella is folded. The inner rope socket 341 is horizontally formed in the outer adapter 34 of the pulling rod 3 for fastening the inner rope end 41 of the pulling rope 4 into the inner rope socket 341. The outer connector 43 of the pulling rope 4 is formed as a helical spring 43 retained in a U-shaped groove formed in the outer portion 212 of the top rib 21 for fastening the outer rope end 42 (which may be formed as a knot) of the rope 4 on the helical spring 43. Naturally, the outer connector 43 may be modified to be other forms or structures.

Besides the coupling or fastening methods as above-mentioned for connecting the rod 3 and the rope 4, for securing the rod 3 on the rib 22 or for fixing the rope 4 on the rib 21, other joining methods such as by adhesive bonding may be used, not limited in this invention.

Figures 13, 14:
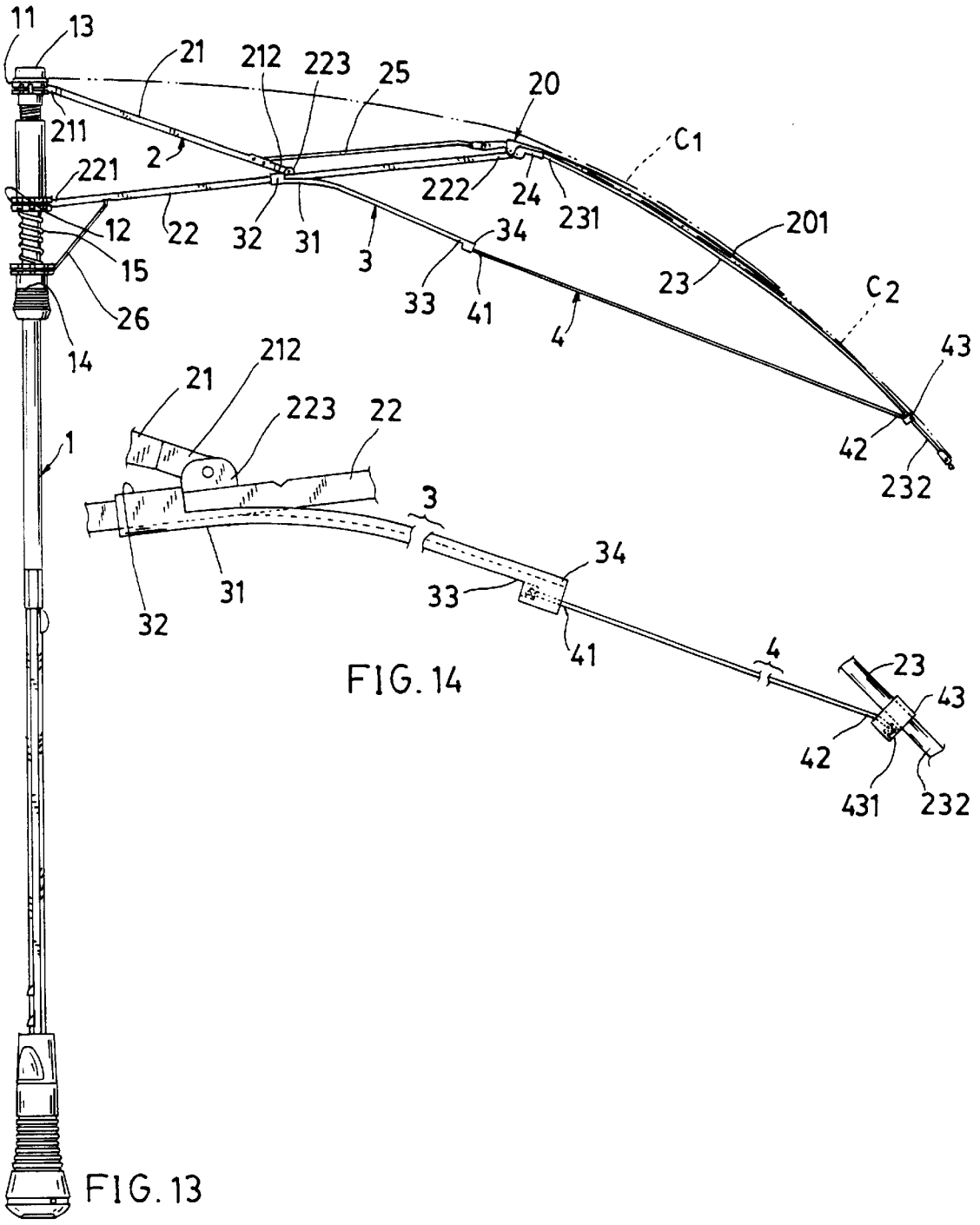
FIG. 13 shows an opened umbrella of still another preferred embodiment of the present invention.
FIG. 14 is an illustration showing the connection of the pulling rod and rope on the umbrella of FIG. 13.
Figure 15:
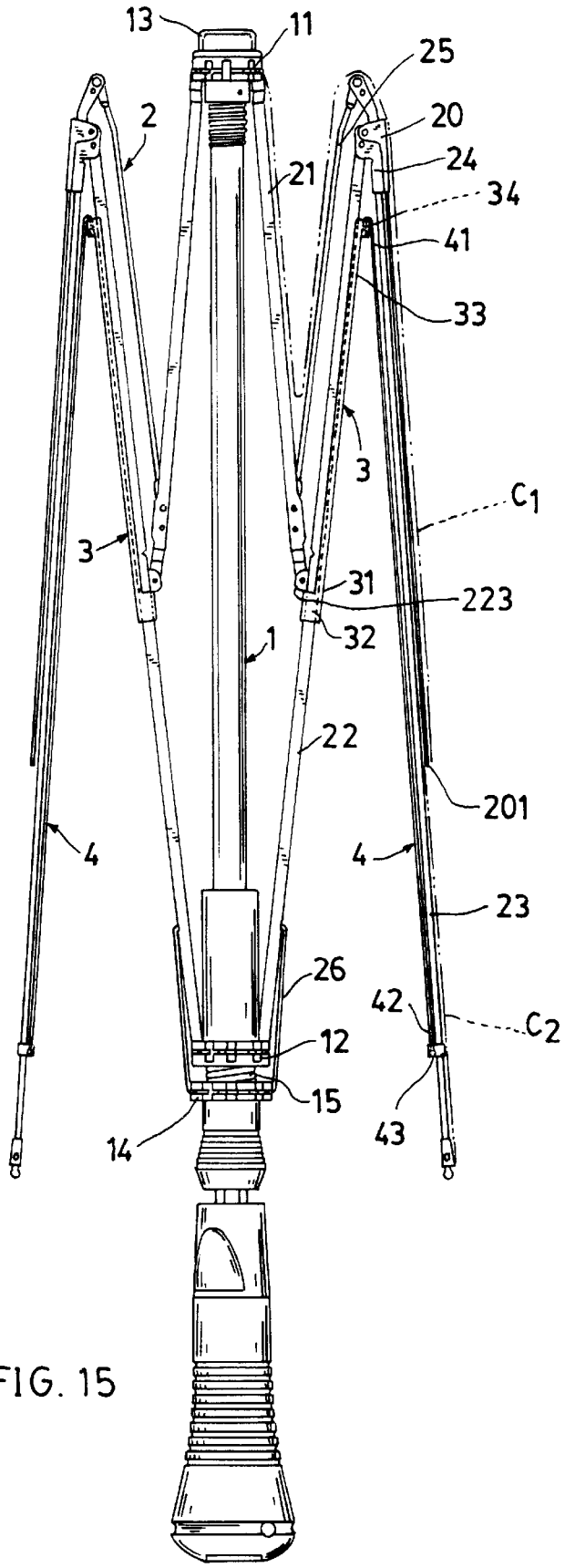
FIG. 15 shows a folded umbrella as folded from FIG. 13.

As shown in FIGS. 13~15, t h e rib assembly 2 includes: a top rib 21 having its inner portion 211 pivotally secured to the upper notch 11, a stretcher rib 22 having its inner portion 221 pivotally secured to a lower runner 12, an outer rib 23 having its inner portion 231 pivotally secured to a joint member 24 which is pivotally secured to an outer portion 222 o f the stretcher rib 22 of which an intermediate rib portion or joining portion 223 is pivotally secured to an outer portion 212 of the top rib 21, a connecting tube 25 pivotally connected between the top rib 21 and the joint member 24, a control valve 20 pivotally secured to the joint member 20 having a spring rod 201 protruding outwardly from the control valve 20 for securing an upper cloth C1 on the spring rod 201 with the upper cloth C1 also secured to the upper notch 11 having a cap 13 capped on the upper notch 11, a lower cloth C2 secured on the outer rib 23, an auxiliary rib 26 pivotally secured between the stretcher rib 22 and a lowest runner 14 slidably held on the central shaft 1, a tension spring 15 retained between the lower runner 12 and the lowest runner 14 for automatically opening the umbrella by the tension spring 15.

Upon blowing of a strong wind towards the umbrella cloths, the upper cloth C1 will be urged upwardly to lift the spring rod 201 of the control valve 20 to open an opening of air passage defined between the upper cloth C1 and the lower cloth C2 secured on the outer rib 23 (or on the joint member 24) to allow the air escaping through the opening between the upper and lower cloths C1, C2 to prevent inversion of the umbrella cloths.

Even though the control valve 20 is provided for escaping air of strong wind as aforementioned, the pulling rod 3 and the pulling rope 4 linked together and secured between the stretcher rib 22 and the outer rib 23 will help fasten the outer rib 23 and the lower cloth C2 secured thereon towards the stretcher rib 22 and the central shaft 1 for stably securing the umbrella cloth on the rib assembly and on the central shaft for preventing inversion of the umbrella cloth.

The pulling rod 3 as shown in FIGS. 13, 14 has an inner adapter 32 formed on an inner rod end 31 of the pulling rod 3 and secured on the stretcher rib 22 adjacent to a joining portion 223 which is formed at an intermediate portion of the stretcher rib 22 for pivotally connecting an outer portion 212 of the top rib 21 on the stretcher rib 22, and an outer adapter 34 formed on an outer rod end 33 of the pulling rod 3 for connecting an inner rope end 41 of the pulling rope 4 on the outer adapter 34 of the rod 3. The pulling rope 4 has its outer rope end 42 secured to an outer rope socket 431 formed in an outer connector 43 of the pulling rope 4, with the outer connector 43 secured on an outer portion 232 of the outer rib 23; whereby upon blowing of a strong wind against the umbrella cloths when the umbrella is opened, the pulling rope 4 and the pulling rod 3 will centripetally fasten the outer rib 23 and the cloth C2 secured thereon towards the stretcher rib 22, the top rib 21 and the central shaft 1 for windproof purpose; and upon folding of the umbrella, the pulling rod 3 will be folded to be leaned on the stretcher rib 22 and the pulling rope 4 will be tensely held between the pulling rod 3 and the outer rib 23 to form a compact folded umbrella without sagging or loosening of the rope 4 (FIG. 15).

The pulling rod 3 as shown in FIG. 14 may be formed with an arcuate groove (as shown in dotted line) recessed downwardly in an upper surface of the pulling rod 3 which is formed as an elongated slim plate or strip in order to be engaged with the stretcher rib 22 when folded.

The pulling rod 3 has a length slightly less than a distance between an intermediate rib portion 223 of the stretcher rib 22 (pivotally connected with the outer portion 212 of the top rib 21) and the joining member 24. The pulling rope 4 has a length slightly less than a length of the outer rib 23 (FIG. 15).

Even the intermediate rib portion 223 is provided for securing the inner adapter 32 of the pulling rod 3 thereon, the inner adapter 32 may also be secured on the stretcher rib 22 adjacent to the inner portion 221 of the stretcher rib 22, not limited in the present invention.

Figures 16, 17, 18:
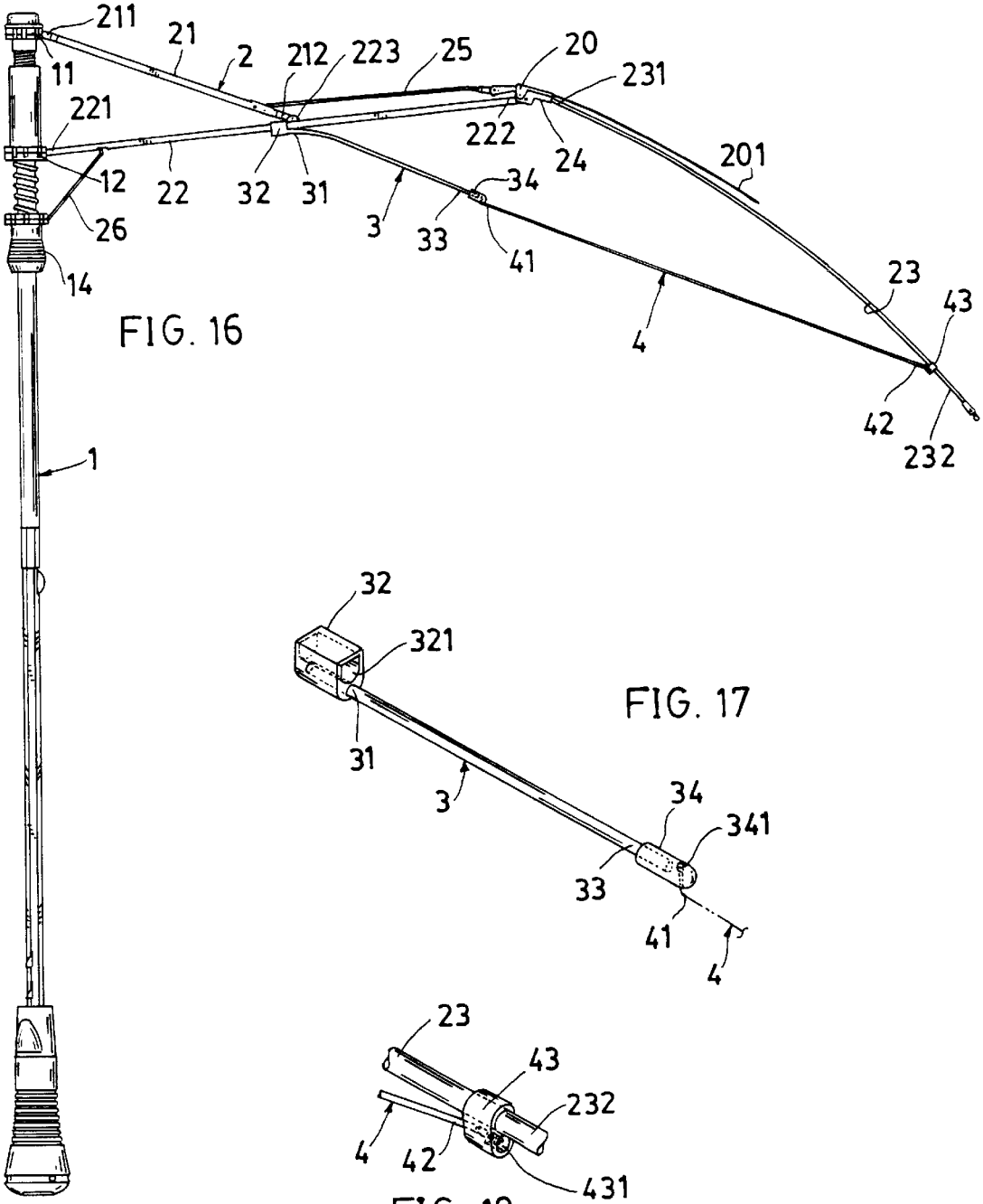
FIG. 16 is a modification of the pulling rod as modified from FIG. 13.
FIG. 17 is a perspective view of the pulling rod of FIG. 16.
FIG. 18 shows the outer rope end of the pulling rope secured on the outer rib of FIG. 16.
Figures 19, 20:
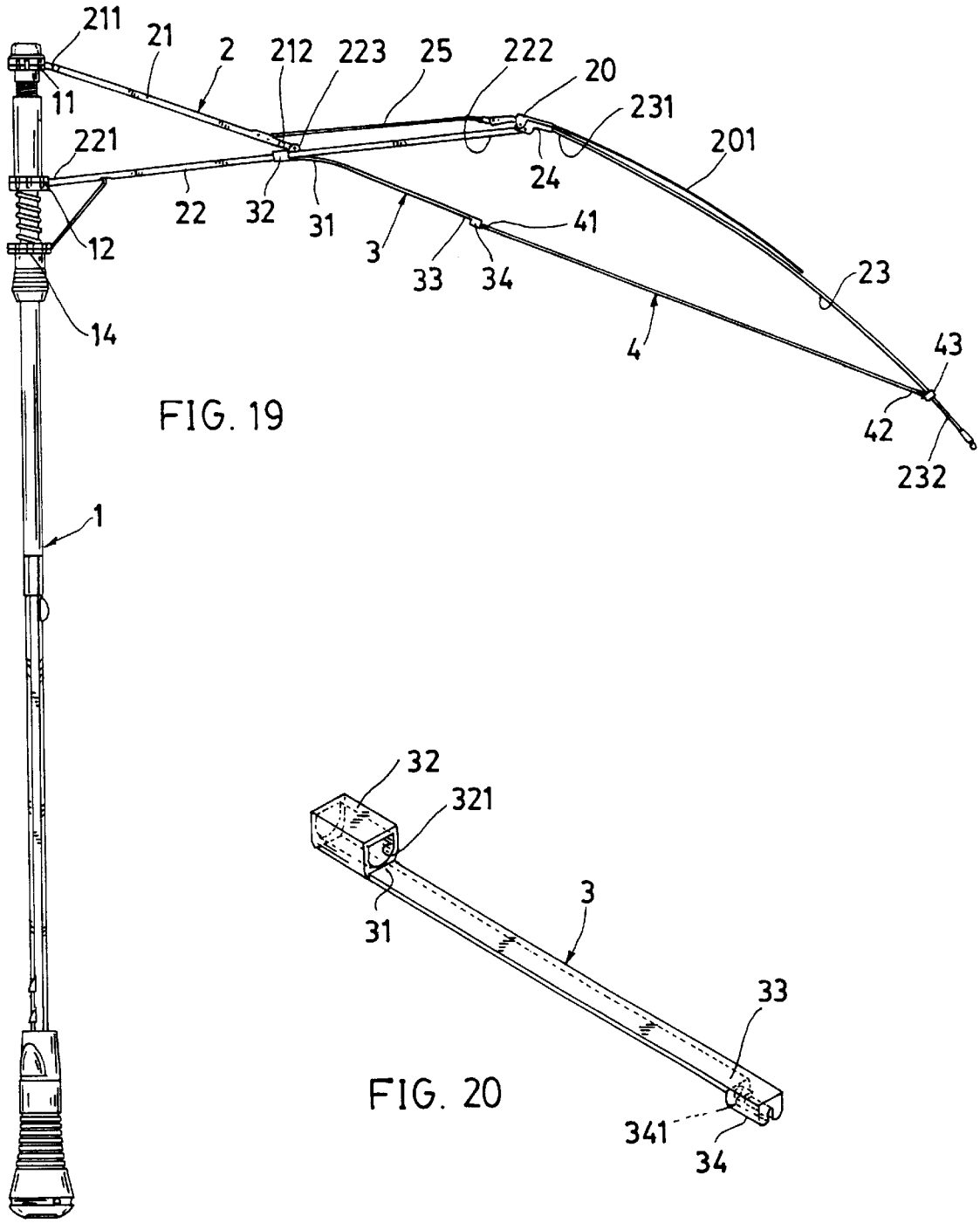
FIG. 19 shows a further modification of the pulling rod of the umbrella as shown in FIG. 13.
FIG. 20 is a perspective view of the pulling rod of FIG. 19.
Figures 21, 22, 23:
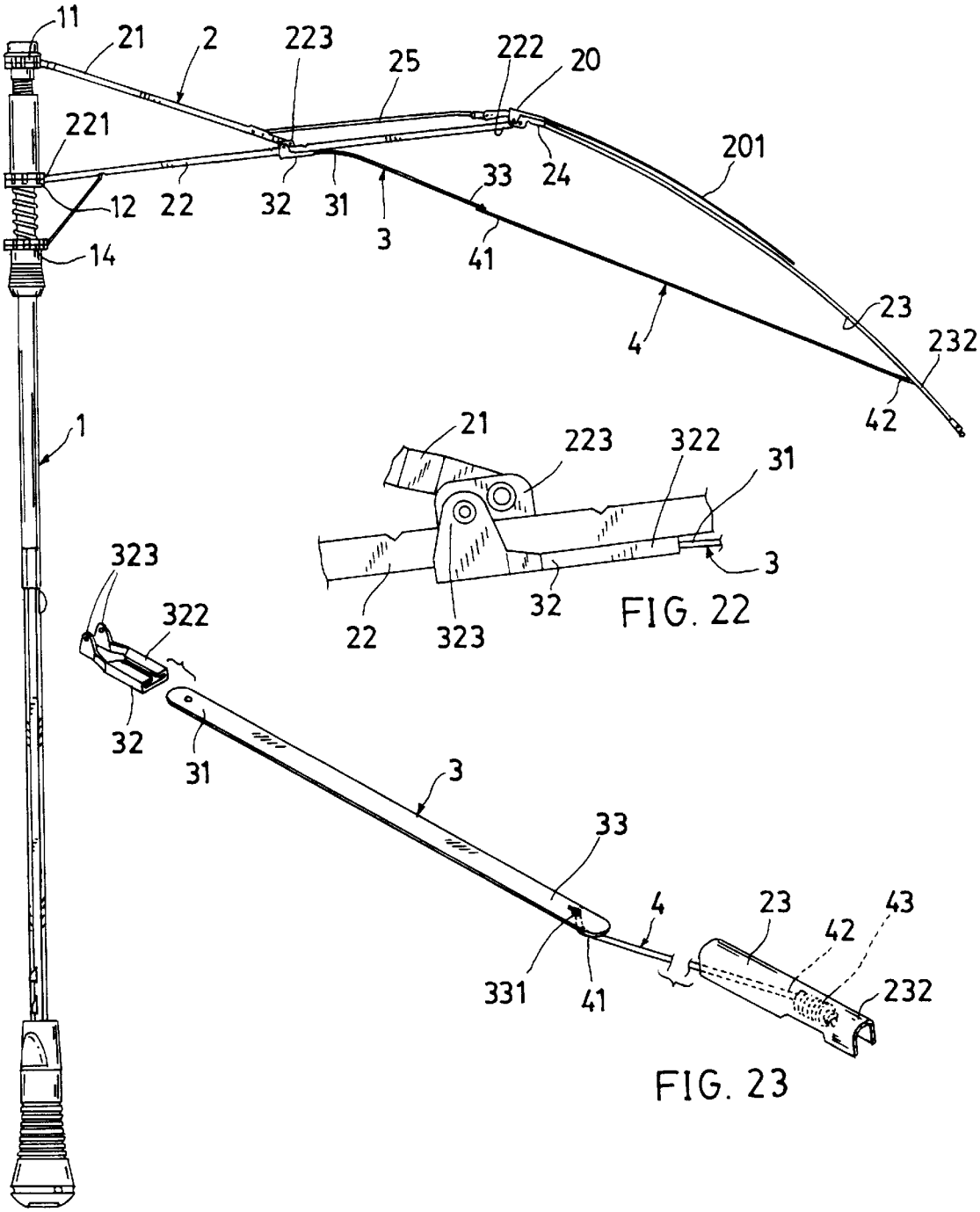
FIG. 21 shows another modification of the pulling rod and rope of the umbrella as modified from FIG. 13.
FIG. 22 is a partial enlarged view showing the inner rod portion of the pulling rod pivotally secured on an intermediate rib portion of the stretcher rib of FIG. 21.
FIG. 23 is an illustration showing the pulling rod and rope of FIG. 21.

As shown in FIGS. 16~18, the pulling rod 3 has been modified to be a circular rod having the outer adapter 34 formed as a cylindrical shape for connecting the inner rope end 41 of the pulling rope 4. The pulling rod 3 as shown in FIGS. 19, 20 is formed as an elongated flat strip. While the inner rod portion 31 of the pulling rod 3 as shown in FIGS. 21~23 is clamped in a pair of crimping edge portions 322 formed on opposite edge portions of the inner adapter 32 (FIG. 23), and the inner adapter 32 further includes a pair of lugs 323 secured to the intermediate rib portion 223 of the stretcher rib 22, with a rope hole 331 formed in an outer rod portion 33 for fastening the inner rope end 41 of the pulling rope 4 on the outer rod portion 33. The outer rope end 42 of the pulling rope 4 is secured to an outer connector 43 formed as a helical spring retained in an outer portion 232 of the outer rib 23.

Figure 24:
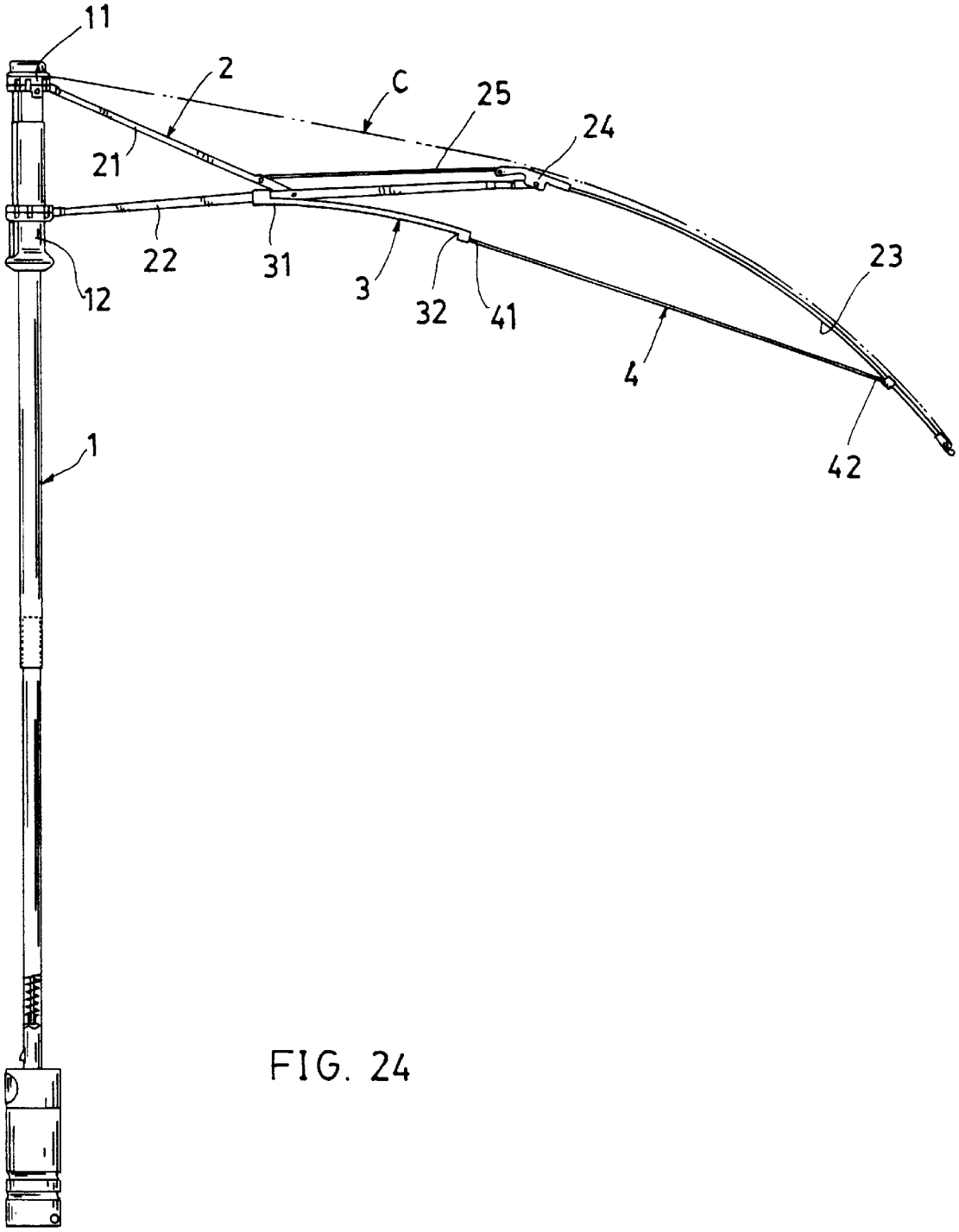
FIG. 24 shows still another preferred embodiment of the present invention.

As shown in FIG. 24, the lowest runner 14 and the spring 15 as shown in FIG. 13 have been eliminated to be a manually operated umbrella, not an automatic umbrella. The umbrella cloth C is also formed as a single cloth secured on the rib assembly 2.

The present invention is superior to the prior art especially to U.S. Pat. No. 5,794,637 with the following advantages:

1. The pulling rope 4 and the pulling rod 3 can be easily linked between the stretcher rib and the top rib (or outer rib) for simplifying the assembly and decreasing the production cost.
2. The pulling rod 3 and the rope 4 will be folded to approximate or lean on the stretcher rib and the top rib (or outer rib), without loosening and sagging, for preventing tangling or influence on the folding or unfolding operation of the umbrella.
3. No suspenders or hangers are required for holding the rod 3 and rope 4 among the umbrella ribs, thereby forming a simple, light and compact umbrella slimly folded and easily carried.

The present invention may be modified without departing from the spirit and scope of this invention. For instance, the positions of the rope 4 and the rod 3 may be shifted or alternated between the stretcher rib and the outer (top) rib.

I claim:

1. A windproof umbrella comprising:

a central shaft having an upper notch formed on said shaft and at least a runner slidably held on said shaft;

a rib assembly consisting of a plurality of umbrella ribs pivotally connected with one another and pivotally secured to said upper notch and said runner, having at least an umbrella cloth secured on said rib assembly;

a pulling rod secured to a rib portion of said rib assembly adjacent to said central shaft; and a pulling rope inwardly linked to said pulling rod and outwardly secured to an outer rib portion of said rib assembly; said pulling rope linked with said pulling rod centripetally fastening said rib assembly and the umbrella cloth secured thereon towards said central shaft for preventing inversion of said umbrella cloth when the umbrella is opened; whereby upon folding of the umbrella, said pulling rod and said pulling rope will be tensely folded among the umbrella ribs of said rib assembly, without sagging and loosening, for forming a compact slim folded umbrella.

2. A windproof umbrella according to claim 1, wherein said pulling rod is made of reinforcing plastic materials having toughness.

3. A windproof umbrella according to claim 1, wherein said pulling rope is made of rope and wire having durable tensile strength.

4. A windproof umbrella according to claim 1, wherein said pulling rod is formed with an arcuate groove recessed in an upper surface of said rod to be engaged with a bottom wall of one said umbrella rib when folded.

5. A windproof umbrella according to claim 1, wherein said pulling rod includes an inner adapter formed on an inner rod portion of said pulling rod and secured to an inner rib portion of said rib assembly, and an outer adapter of said pulling rod for connecting an inner rope end of said pulling rope; said pulling rope having an outer rope end connected to an outer portion of said outer rib portion.

6. A windproof umbrella according to claim 5, wherein said pulling rod has an inner adapter formed with a rib hole therein for inserting an umbrella rib in said rib hole for securing said inner adapter of said pulling rod on said umbrella rib.

7. A windproof umbrella according to claim 5, wherein said pulling rope includes an outer connector secured to said outer rib portion of said rib assembly for securing the outer rope end of said rope on said outer connector.

8. A windproof umbrella according to claim 7, wherein said outer connector of said pulling rope is formed as a helical spring retained in a groove formed in said outer rib portion.

9. A windproof umbrella according to claim 1, wherein said rib assembly includes: a top rib pivotally secured to said upper notch, a stretcher rib pivotally secured to a lower runner slidably held on said central shaft and secured with said top rib; said pulling rod having an inner rod portion secured to an inner portion of said stretcher rib; and said pulling rope as linked with said pulling rod having an outer rope end secured to an outer portion of said top rib.

10. A windproof umbrella according to claim 9, wherein said pulling rod has a length ranging from a half length to a full length of said stretcher rib.

11. A windproof umbrella according to claim 9, wherein said pulling rope has a length ranging from a half distance to a full distance between an outer portion of the top rib, and a joining portion of the top rib with the stretcher rib.

12. A windproof umbrella according to claim 1, wherein said rib assembly includes: a top rib pivotally secured to said upper notch, a stretcher rib pivotally secured to a lower runner slidably held on said shaft and secured to said top rib, an outer rib secured to a joint member secured to said stretcher rib, a connecting rib secured between said top rib and said joint member; said pulling rod having an inner rod end of said rod secured to said stretcher rib; and said pulling rope linked with said pulling rod and having an outer rope end of said rope secured to an outer portion of said outer rib.

13. A windproof umbrella according to claim 12, wherein said pulling rod includes an inner adapter formed on an inner rod portion of said rod and secured to said stretcher rib adjacent to a joining portion on said stretcher rib, with said joining portion pivotally connecting an outer portion of said top rib to said stretcher rib.

14. A windproof umbrella according to claim 13, wherein said inner adapter includes a pair of lugs secured to the joining portion of the stretcher rib, and a pair of crimping edge portions of said inner adapter for clamping the inner rod portion of said pulling rod.

15. A windproof umbrella according to claim 12, wherein said rib assembly further includes a control valve pivotally secured to said joint member having a spring rod protruding outwardly from said control valve, an upper cloth secured on said spring rod, a lower cloth secured to said outer rib, an opening of air passage defined between said upper and lower cloths allowing air escape from said opening between the upper and lower cloths, an auxiliary rib pivotally secured to said stretcher rib and a lowest runner slidably held on said central shaft below said lower runner, and a tension spring retained between said lower and said lowest runners for automatically opening the umbrella.

* * * * *